US010947695B2

(12) United States Patent
Lu et al.

(10) Patent No.: US 10,947,695 B2
(45) Date of Patent: Mar. 16, 2021

(54) SUBMARINE CABLE TRENCHER

(71) Applicants: ZHOUSHAN ELECTRIC POWER SUPPLY COMPANY OF STATE GRID ZHEJIANG ELECTRIC POWER COMPANY, Zhejiang (CN); ZHEJIANG ZHOUSHAN MARINE POWER TRANSMISSION RESEARCH INSTITUTE CO., LTD., Zhejiang (CN); STATE GRID ZHEJIANG ELECTRIC POWER CO., LTD, Zhejiang (CN); HANGZHOU AOHAI MARINE ENGINEERING CO., LTD, Zhejiang (CN)

(72) Inventors: Zhifei Lu, Zhejiang (CN); Zhenxin Chen, Zhejiang (CN); Enke Yu, Zhejiang (CN); Lei Zhang, Zhejiang (CN); Boda Zhou, Zhejiang (CN); Guozhi Chen, Zhejiang (CN); Peiqi Shen, Zhejiang (CN); Qiang Jing, Zhejiang (CN); Chun Gan, Zhejiang (CN); Kai Hu, Zhejiang (CN); Zhou Yu, ZheJiang (CN); Yinxian Zhang, Zhejiang (CN)

(73) Assignees: ZHOUSHAN ELECTRIC POWER SUPPLY COMPANY OF STATE GRID ZHEJIANG ELECTRIC POWER COMPANY, Zhejiang (CN); ZHEJIANG ZHOUSHAN MARINE POWER TRANSMISSION RESEARCH INSTITUTE CO., LTD., Zhejiang (CN); STATE GRID ZHEJIANG ELECTRIC POWER CO., LTD., Hangzhou (CN); HANGZHOU AOHAI MARINE ENGINEERING CO., LTD., Hangzhou (CN)

( * ) Notice: Subject to any disclaimer, the term of this patent is extended or adjusted under 35 U.S.C. 154(b) by 0 days.

(21) Appl. No.: 16/608,095

(22) PCT Filed: Jul. 12, 2019

(86) PCT No.: PCT/CN2019/095858

§ 371 (c)(1),
(2) Date: Oct. 24, 2019

(87) PCT Pub. No.: WO2020/206859

PCT Pub. Date: Oct. 15, 2020

(65) Prior Publication Data

US 2020/0318314 A1 Oct. 8, 2020

(30) Foreign Application Priority Data

Apr. 8, 2018 (CN) ..... 201910276455.9

(51) Int. Cl.
*E02F 5/10* (2006.01)

(52) U.S. Cl.
CPC ..... *E02F 5/105* (2013.01); *E02F 5/107* (2013.01); *E02F 5/109* (2013.01)

(58) Field of Classification Search
CPC ..... E02F 5/105; E02F 5/109
See application file for complete search history.

(56) References Cited

U.S. PATENT DOCUMENTS 3,434,297 A * 3/1969 Spollen ..... E02F 5/105 405/160
3,990,377 A * 11/1976 Marquinez ..... H04B 5/0093 405/159

(Continued)

FOREIGN PATENT DOCUMENTS

CN 103790202 A 5/2014
CN 105673017 A 6/2016

(Continued)

OTHER PUBLICATIONS

International Search Report for the International Patent Application No. PCT/CN2019/095858, dated Jan. 2, 2020, 3 pages.

*Primary Examiner* — Benjamin F Fiorello
(74) *Attorney, Agent, or Firm* — Kacvinsky Daisak Bluni PLLC

(57) ABSTRACT

A trencher includes a trencher body; a cable detection mechanism disposed at a front portion of the trencher body; a chain mechanism and a jet mechanism disposed in the center of a bottom portion of the trencher body; a first track (Continued)

mechanism and a second track mechanism, the first track mechanism being disposed on a first side of the bottom portion of the trencher body, and the second track mechanism being disposed on a second side of the bottom portion of the trencher body; and a soil discharging component disposed at a rear portion of the trencher body.

7 Claims, 6 Drawing Sheets

(56) References Cited

U.S. PATENT DOCUMENTS

| | | | | | |
|---|---|---|---|---|---|
| 4,714,379 | A * | 12/1987 | Gilchrist, Jr. | E02F 5/06 | 405/158 |
| 4,721,409 | A * | 1/1988 | Harmstorf | E02F 3/10 | 37/323 |
| 4,749,308 | A * | 6/1988 | Izawa | E02F 5/105 | 37/309 |
| 6,719,494 | B1 * | 4/2004 | Machin | E02F 3/9206 | 37/344 |
| 2002/0017041 | A1 * | 2/2002 | Gloppen | E02F 3/9206 | 37/344 |
| 2007/0253780 | A1 * | 11/2007 | Pihl | E02F 5/105 | 405/184 |
| 2014/0283421 | A1 * | 9/2014 | Manchester | E02F 3/9268 | 37/309 |
| 2016/0215476 | A1 * | 7/2016 | Walker | E02F 9/003 | |
| 2018/0216314 | A1 * | 8/2018 | Bonel | E02F 5/105 | |
| 2020/0165796 | A1 * | 5/2020 | Manchester | E02F 5/107 | |

FOREIGN PATENT DOCUMENTS

| | | | |
|---|---|---|---|
| CN | 107344607 | A | 11/2017 |
| CN | 108019564 | A | 5/2018 |
| CN | 208455697 | U | 2/2019 |
| EP | 2361333 | A1 | 8/2011 |
| JP | 08189059 | A | 7/1996 |
| RU | 2612421 | C1 | 3/2017 |
| WO | 2010015851 | A1 | 2/2010 |

* cited by examiner

SUBMARINE CABLE TRENCHER

CROSS-REFERENCE TO RELATED APPLICATIONS

This is a National Stage Application, filed under 35 U.S.C. 371, of International Patent Application No. PCT/CN2019/095858, filed on Jul. 12, 2019, which claims priority to Chinese patent application No. 201910276455.9 filed on Apr. 8, 2019, contents of both of which are incorporated herein by reference in their entireties.

TECHNICAL FIELD

The present disclosure relates to the field of submarine cable laying and, for example, to a submarine cable trencher.

BACKGROUND

Submarine cables are disposed in a complex marine environment in the seabed, such as seabed currents, irregular seabed, seabed deposit (soil) instability and operational water depth. These cause drag force, increase of buoyancy, scour on the suspended span, etc., reducing the stability of submarine cables in the seabed. External anchors and falling objects make external mechanical damage to submarine cables. Direct or indirect loss of submarine cables amounts to hundreds of millions of yuan.

Trenchers can bury the submarine cables to a predetermined depth, so as to improve the submarine cable stability in the seabed and reduce external mechanical damage. Such a method can effectively protect the submarine cables from external force damage caused by anchor, trawl, etc. A manner of trenching and burying is most economical and effective among protection and stabilization measures for the submarine cables.

The trenchers have various trenching modes. Among the trenching modes in the related art, plough-type trenching is mainly used, and its principle is to break the soil in the seabed with a plough-shaped structure. A trenching mode of liquefying soil with jet flow or a mechanical trenching mode is also used overseas. For example, the mechanical trenching mode is trenching with a cylindrical milling cutter or a chain saw. In domestic, however, researches on these trenching modes start late, and the trenching modes have rare actual applications and are mostly in the conceptual stage.

In the related art, there are two main drive types for marching the trenchers. One type is a drag trencher under the power from a mother ship. The drag-type trencher is commonly embodied as the plough trencher. The plough trencher works in a following mode: the mother ship drags the plough to trench a trench in the seabed and then buries a pipeline or cable into the trench. The plough trencher greatly depends on the mother ship, has a small operation depth, cannot fill the trench after laying the cable, and has too many limitations on trenching. The other type is a self-propelled trencher, the main feature of which is provision of an automatic walking mechanism such as crawler belts and wheels on the chassis. In general, the existing domestic trenchers lack autonomy, have great dependence on the mother ship, single trenching mode and limited scope of application.

SUMMARY

The present disclosure provides a submarine cable trencher, which may use a dual-operation mode combining crawler self-propelled mechanical soil breaking and jet soil breaking.

An embodiment provides a submarine cable trencher. The trencher includes a trencher body; a cable detection mechanism disposed at a front portion of the trencher body; a chain mechanism and a jet mechanism disposed in the center of a bottom portion of the trencher body; a first track mechanism and a second track mechanism, where the first track mechanism is disposed on a first side of the bottom portion of the trencher body, and the second track mechanism is disposed on a second side of the bottom portion of the trencher body; and a soil discharging component disposed at a rear portion of the trencher body.

DETAILED DESCRIPTION

Figure 1:
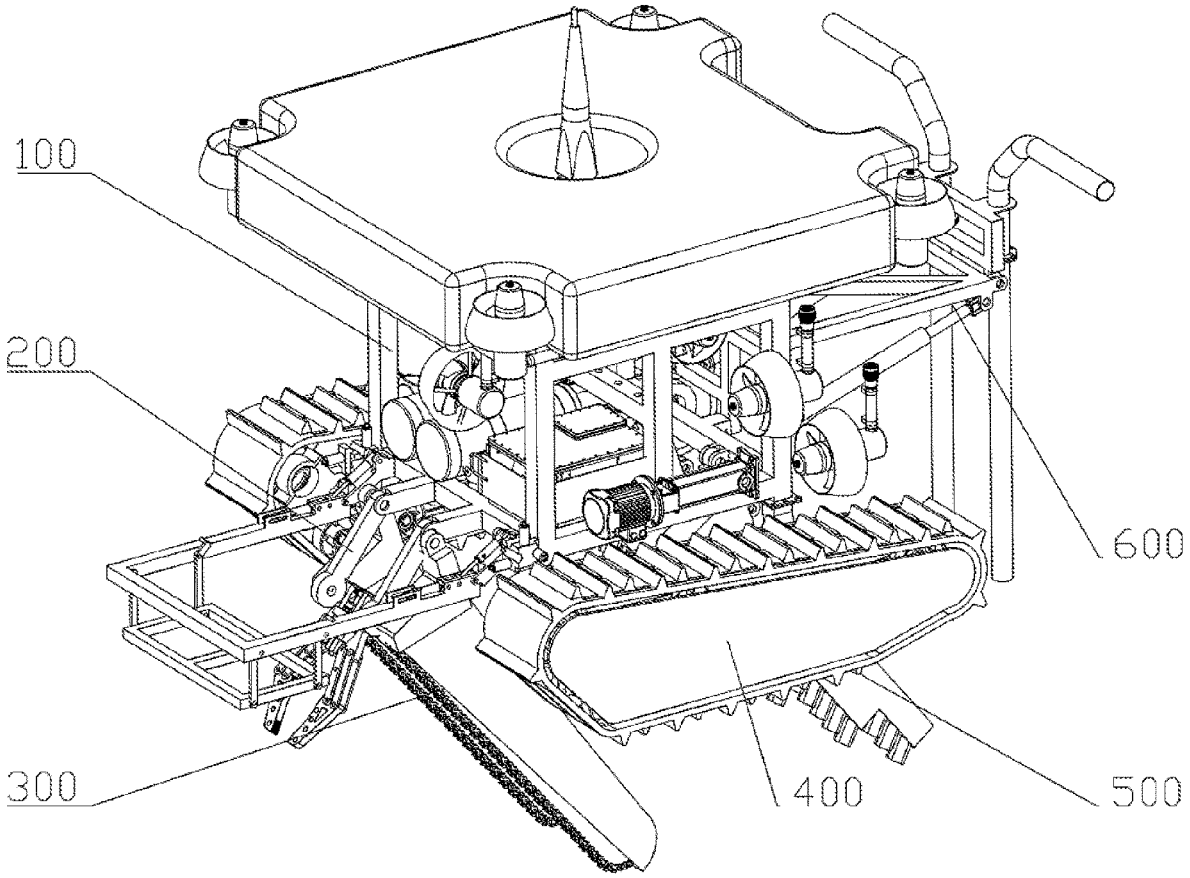
FIG. 1 is a schematic diagram of a submarine cable trencher according to an embodiment of the present disclosure.

An embodiment provides a trencher with a dual-operation mode for a submarine cable. As shown in FIG. 1, the submarine cable trencher includes six parts, i.e., a trencher body 100, a cable detection mechanism 200, a chain mechanism 300, a track mechanism 400, a jet mechanism 500 and a soil discharging component 600. The trencher body 100 is a base basket. A functional component, a soil breaking mechanism and a walking mechanism are installed on the trencher body 100. The functional component includes the cable detection mechanism 200, the chain mechanism 300, the jet mechanism 500 and the soil discharging component 600. In the embodiment, the walking mechanism includes two track mechanisms 400. The two track mechanisms 400 are installed on opposite sides of the bottom portion of the trencher body 100. The chain mechanism 300 and the jet mechanism 500 belong to the soil breaking mechanism and are installed in the center of the bottom portion of the trencher body 100. The cable detection mechanism 200 is configured to provide cable position information and lift the cable.

The cable detection mechanism 200 is installed at the front portion of the trencher body 100. The soil discharging component 600 is disposed at the rear portion of the trencher body 100 and discharges excavated soil.

The trencher provided by the embodiment has an automatic cable searching and detecting function and may adjust a trend of the machine according to a trend of the cable. The cable is buried with the track mechanism 400 as a travel mechanism, the jet flow soil breaking technology as a main trenching technology and the mechanical soil breaking as an auxiliary technology.

The operation of the submarine cable trencher is mainly divided into two stages. In a first stage, the trencher arrives an operation site under manual control; in a second stage, the trencher digs for a trench according to the trend of the submarine cable.

Figure 2:
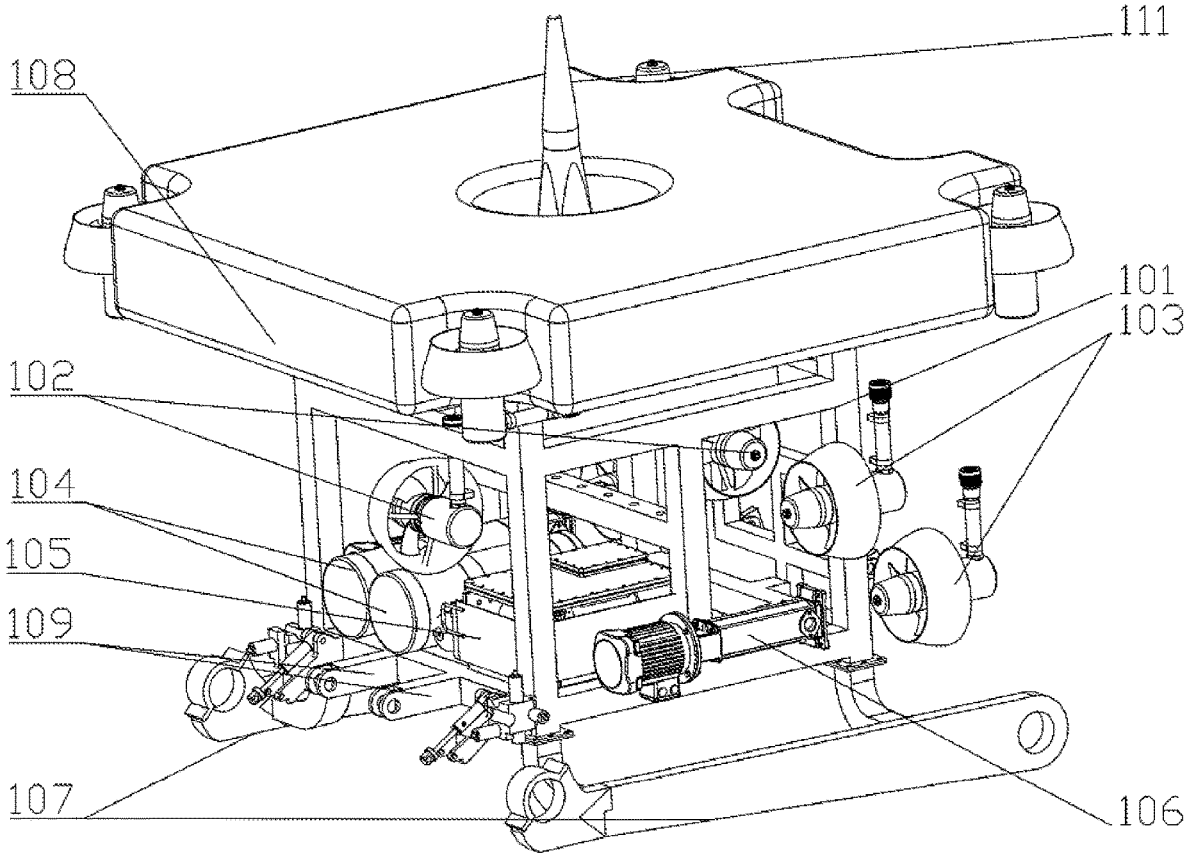
FIG. 2 is a schematic diagram of a trencher body according to an embodiment of the present disclosure.

The trencher body 100 is a basic part of the whole trencher. As shown in FIG. 2, the trencher body 100 includes a chassis 101, a hanger 111, a control cabin 104, a hydraulic box 105 and track installation plates 107. The chassis 101 is an installation base of the trencher body 100 and is formed of titanium alloy tubes through welding. The track installation plates 107 are welded at the bottom portion of the chassis 101 and are configured to install the track mechanism. The hanger 111 is disposed at the top portion of the chassis 101 and is configured to deploy and withdraw the trencher. The control cabin 104 and the hydraulic box 105 are disposed at the lower portion of the chassis 101. A control system of the machine and a class-electronic element are disposed in the control cabin 104. A hydraulic system available to the trencher is disposed in the hydraulic box 105.

Figure 3:
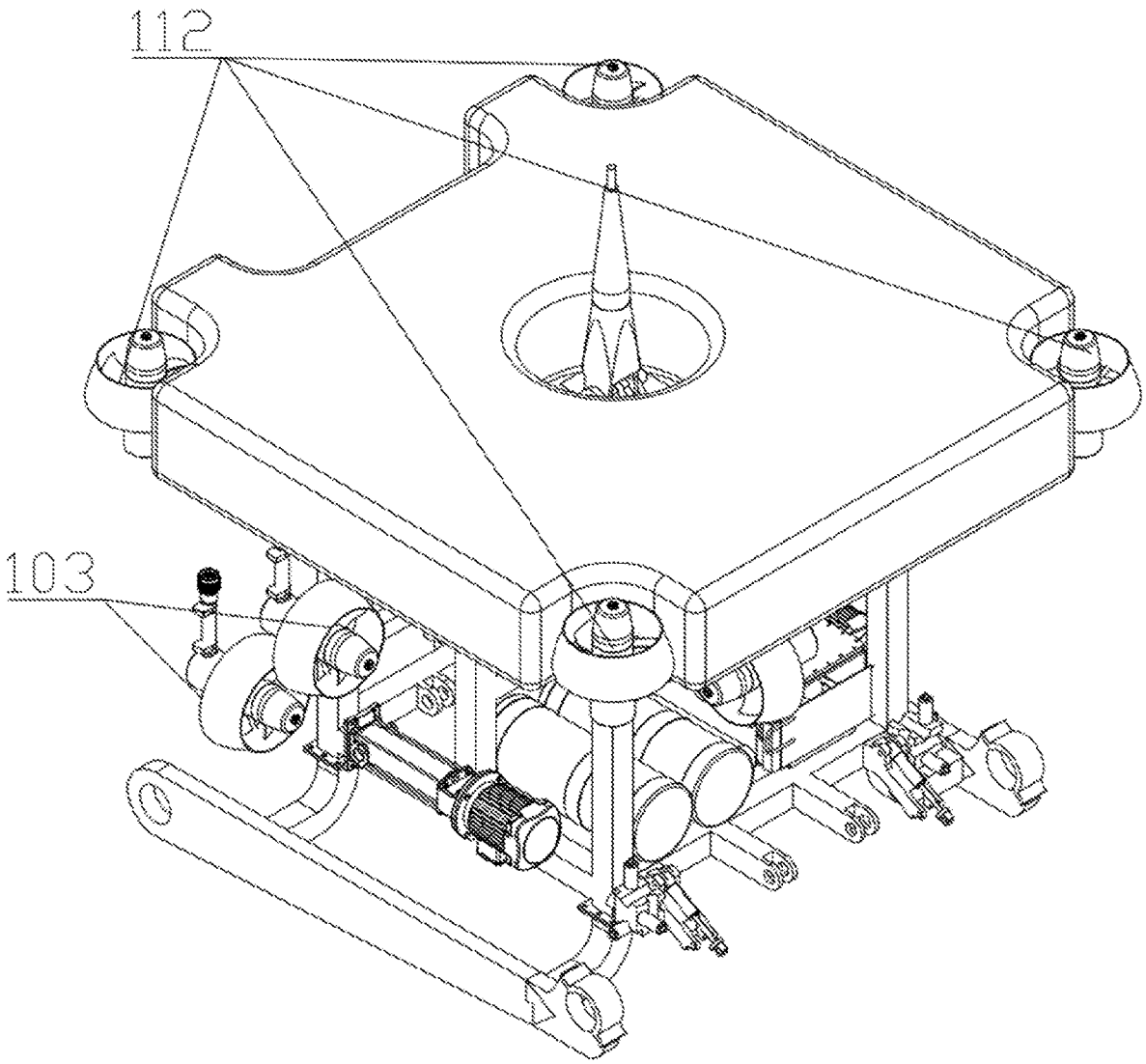
FIG. 3 is an isometric diagram of a trencher body according to an embodiment of the present disclosure.

As shown in FIGS. 2 and 3, the submarine cable trencher further includes four vertical propellers 112, a transverse propeller 102, a longitudinal propeller 103 and a buoyancy part 108 installed at the top portion of the trencher body 100. The four vertical propellers 112 are installed around the buoyancy part 108 and are configured to make the trencher ascend or descend. The function of the buoyancy part 108 is to balance a posture of the trencher, so that the trencher can maintain a correct posture while moving. As shown in FIGS. 2 and 3, the four vertical propellers 103 are installed behind the chassis 101 and are configured to control the trencher to move forward and back. As shown in FIG. 2, two transverse propellers 102 are installed in the middle of the chassis 101 and may make the trencher move transversely.

In the first stage, the main moving component is the above-mentioned ten propellers. With internal control of the system, the trencher may be manually controlled to move to the operation site.

The operation in the second stage may be divided into following steps. The cable detection mechanism 200 pulls up the cable, the chain mechanism 300 and the jet mechanism 500 start a trenching operation, and the track mechanism 400 starts to move, so as to ensure a continuous trenching operation. During the trenching operation, the soil discharging component 600 sucks out broken seabed substrates in the trench in time and sprays to both sides of the trench.

The construction of the track mechanism 400 is similar to a track mechanism structure in the relate art. The track mechanism 400 includes a crawler belt 401 and belt wheels 403. The crawler belt 401 is provided with grousers 402 for increasing a friction force. In the process of moving forward, the grousers 402 may provide a large friction force to facilitate the movement on the seabed. Mudguards 404 are disposed on both sides of the belt wheels 403. The mudguards 404 protect an internal mechanism of the track mechanism 400.

Figure 5:
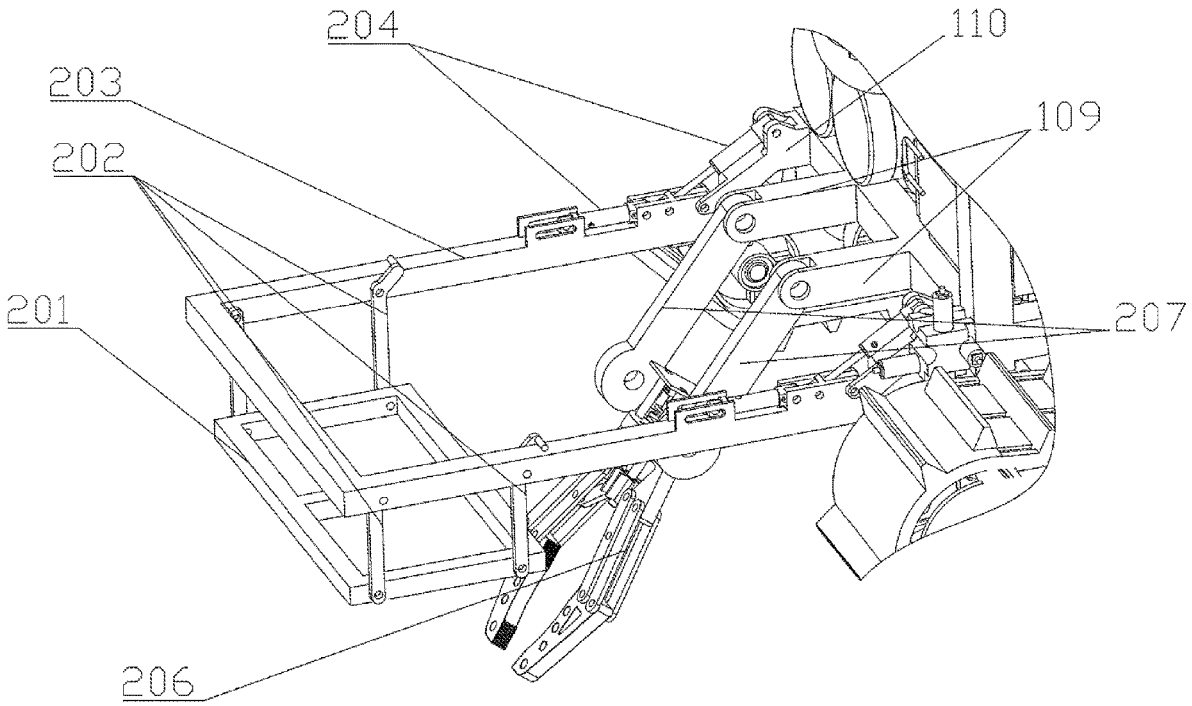
FIG. 5 is a schematic diagram of a cable detection mechanism according to an embodiment of the present disclosure.
Figure 4:
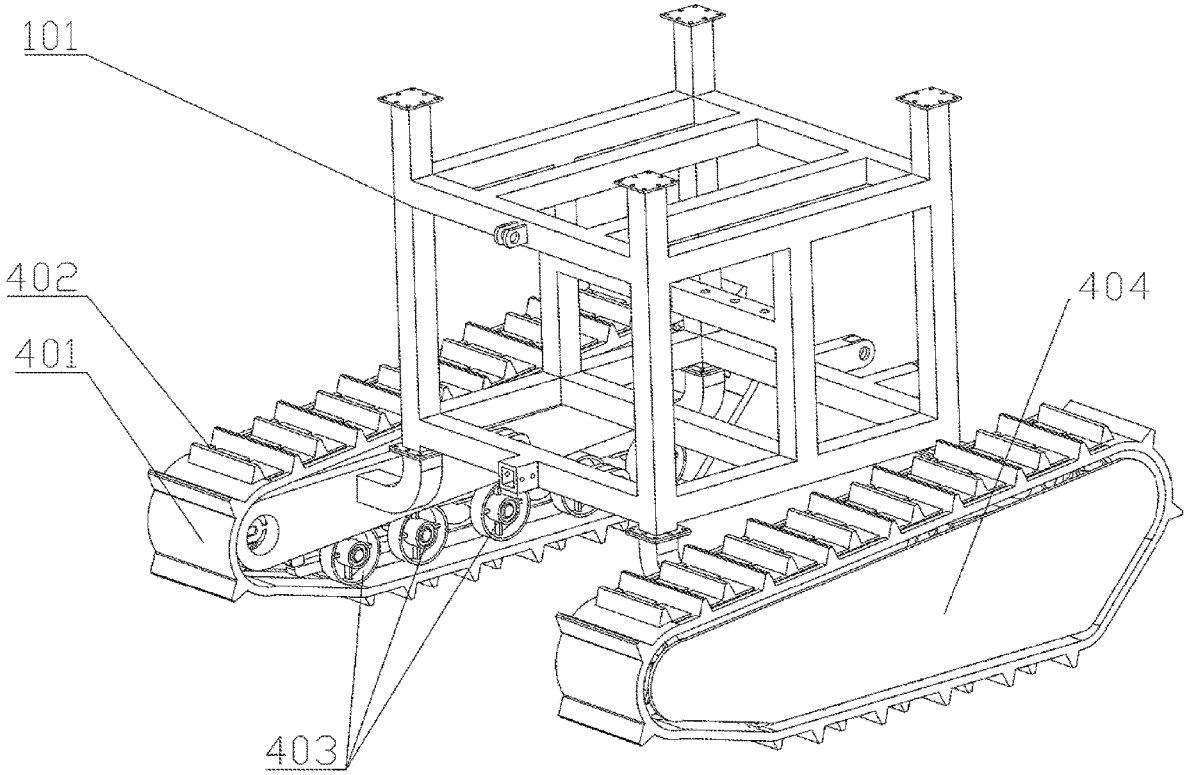
FIG. 4 is a schematic diagram of a track mechanism according to an embodiment of the present disclosure.

As shown in FIG. 5, the cable mechanism 200 includes a cable detection coil 201, a connecting rod 202, a telescopic arm 203, a hydraulic cylinder 204, an arm plate 110, a chassis arm 109, a mechanical arm 207 and a mechanical hand 206. The cable detection coil 201 is installed on the telescopic arm 203 through the connecting rod 202. The telescopic arm 203 is installed on the arm plate 110 and is controlled by the hydraulic cylinder 204 to move up and down. The arm plate 110 is welded on the chassis 101. The mechanical hand 206 is installed on the chassis arm 109 through the mechanical arm 207. The chassis arm 109 is fixed on the chassis 101.

During the operation, when the cable detection coil 201 finds the cable, the mechanical hand 206 grasps the cable and makes the cable suspended, so as to ensure smooth trenching.

Figure 6:
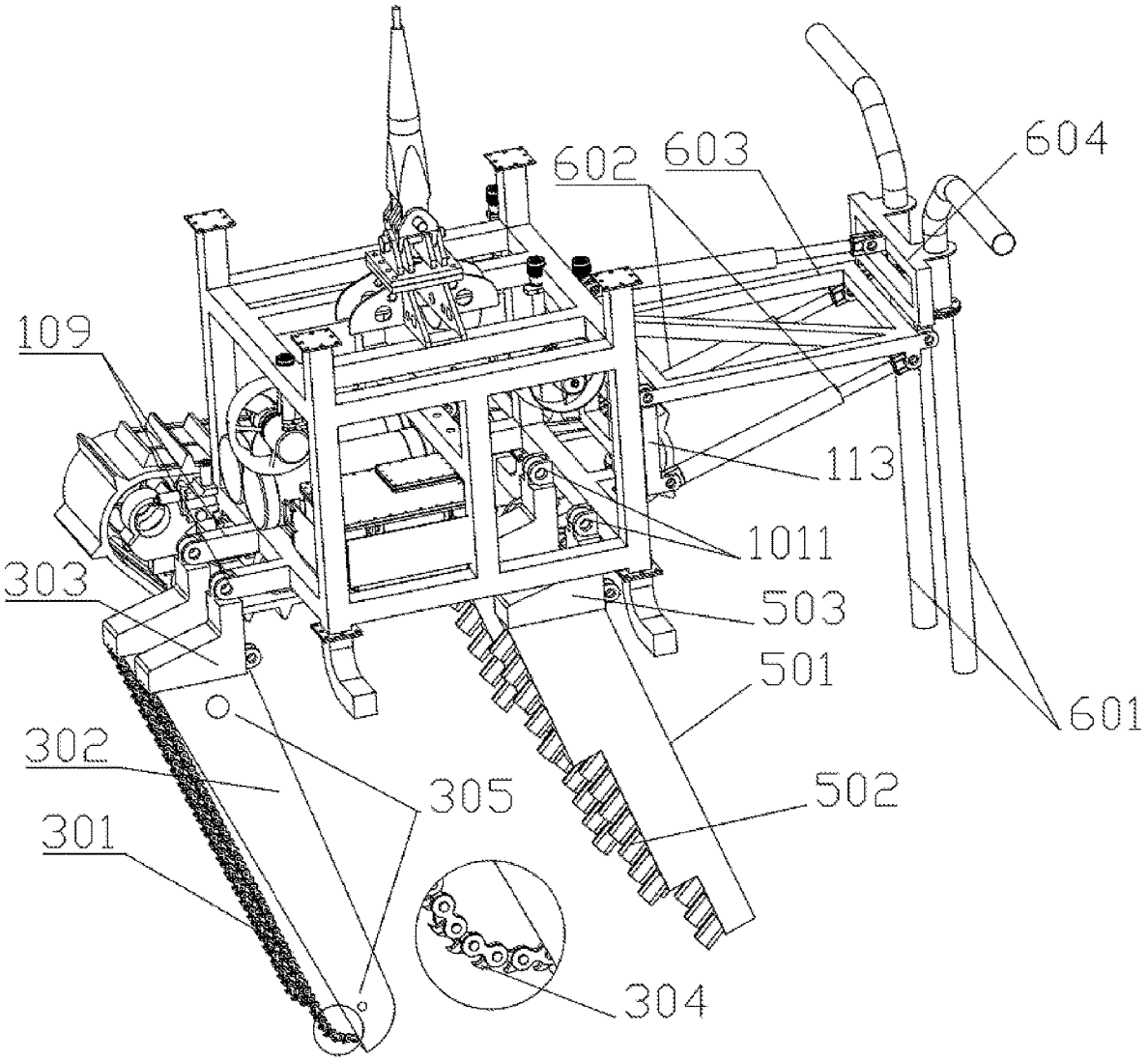
FIG. 6 is a schematic diagram of a submarine cable trencher from another perspective according to an embodiment of the present disclosure.

As shown in FIG. 6, the chain mechanism 300 includes a chain saw 301, baffles 302 and a chain arm 303. The baffles 302 are welded on the chain arm 303 and are disposed on both sides of the chain saw 301. The chain saw 301 is connected to the baffles 302 through an axle 305. The chain arm 303 is installed on the chassis arm 109. The chain saw 301 is provided with chain teeth 304 configured to cut a hard substrate in the seabed. In the high-speed operation of the chain saw 301, the chain teeth 304 is capable of easily cutting the soil.

As shown in FIG. 6, the jet mechanism 500 includes a jet arm 501 and a jet plate 503. The jet arm 501 is provided with multiple nozzles 502. The nozzles 502 may spray high-speed water to liquefy the soil. The jet arm 501 is installed on the chassis 101 through the jet plate 503 and an installation hole 1011 of the chassis 101.

As shown in FIG. 6, the soil discharging component 600 includes a soil discharging tube 601, a soil discharging hydraulic cylinder 602, a soil discharging frame 603 and a tube frame 604. The soil discharging tube 601 is installed on the tube frame 604, and the height of the tube frame 604 may be adjusted freely. The chassis 101 includes a soil discharging rack 113. The tube frame 604 is installed on the soil discharging rack 113 of the chassis 101 through the soil discharging frame 603. The soil discharging hydraulic cylinder 602 may control the soil discharging tube 601, the soil discharging frame 603 and the tube frame 604 to move up and down. In the operation, the soil discharging hydraulic cylinder 602 lowers the soil discharging tube 601, the soil discharging frame 603 and the tube frame 604 to implement a soil discharging function.

The unstated part of the structural design in the embodiment is the same as that of the related art or is implemented using the related art.

When the submarine cable trencher of the embodiment moves, the combination of propeller vector control and a track structure allows the submarine cable trencher to walk on the seabed under manual control. The trenching mode includes the chain saw and the jet to break the soil simultaneously, which can break rocks or sediment in the seabed.

Compared with the related art, the beneficial effects of the present application are as follow: the propeller vector control can manually manage the operation site very well; the track mechanism 400 can walk well on the seabed and is suitable for various seabed terrains; and the combination of the mechanical soil breaking mechanism and the jet breaking flow can cut various seabed substrates and has a wide range of operation objects.

What is claimed is:

1. A submarine cable trencher, comprising:

a trencher body;

a cable detection mechanism, which is disposed at a front portion of the trencher body;

a chain mechanism and a jet mechanism, which are installed in the center of a bottom portion of the trencher body;

a first track mechanism and a second track mechanism, wherein the first track mechanism is disposed on a first side of the bottom portion of the trencher body, and the second track mechanism is disposed on a second side of the bottom portion of the trencher body; and a soil discharging component, which is disposed at a rear portion of the trencher body;

wherein the trencher body comprises a chassis, a plurality of track installation plates and a hanger, wherein the chassis is formed of titanium alloy tubes through welding, the track installation plates are disposed at a bottom portion of the chassis, the hanger is disposed at a top portion of the chassis; and the trencher further comprises a control cabin and a hydraulic box, wherein the control cabin and the hydraulic box are disposed at a lower portion of the chassis, the chassis is respectively connected to the cable detection mechanism, the chain mechanism, the jet mechanism and the soil discharging component.

2. The trencher of claim 1, further comprising a buoyancy part disposed at a top portion of the trencher body, four vertical propellers disposed circumferentially around the buoyancy part, a longitudinal propeller disposed at a rear portion of the chassis and a transverse propeller disposed in the middle of the chassis.

3. The trencher of claim 1, wherein each of the first track mechanism and the second track mechanism both comprises a crawler belt, a plurality of belt wheels and two mudguards, wherein the crawler belt is provided with a plurality of grousers for increasing a friction force, the two mudguards of the first track mechanism are disposed on both sides of the belt wheels of the first track mechanism, and the two mudguards of the second track mechanism are disposed on both sides of the belt wheels of the second track mechanism.

4. The trencher of claim 1, wherein the cable detection mechanism comprises a cable detection coil, a connecting rod, a telescopic arm, an arm plate, a hydraulic cylinder, a mechanical hand and a mechanical arm, wherein the cable detection coil is disposed on the telescopic arm through the connecting rod, the telescopic arm is disposed on the arm plate, the hydraulic cylinder is disposed on the telescopic arm and is configured to control the telescopic arm to move up and down, and the chassis comprises a chassis arm, wherein the mechanical hand is disposed on the chassis arm through the mechanical arm.

5. The trencher of claim 4, wherein the chain mechanism comprises a chain saw, a plurality of baffles and a chain arm, wherein the baffles are disposed on both sides of the chain saw, the chain saw is disposed on the baffles, end of the baffles has an end fixedly connected to the chain arm, the chain arm is disposed on the chassis arm, and the chain saw is provided with a plurality of chain teeth for cutting a hard substrate in a seabed.

6. The trencher of claim 1, wherein the jet mechanism comprises a jet arm and a jet plate, wherein the jet arm is provided with a plurality of nozzles, and the jet arm is disposed on the chassis through the jet plate and an installation hole of the chassis.

7. The trencher of claim 1, wherein the soil discharging component comprises a soil discharging tube, a soil discharging frame and a tube frame, wherein the soil discharging tube is disposed on the tube frame, the trencher body comprises a soil discharging rack disposed on the chassis, and the tube frame is disposed on the soil discharging rack through the soil discharging frame.

* * * * *